US006151044A

United States Patent [19]

Gaasch

[11] Patent Number: 6,151,044

[45] Date of Patent: Nov. 21, 2000

[54] HIDE-AWAY WIPER CLEANER FOR INKJET PRINTHEADS

[75] Inventor: Todd Michael Gaasch, Vancouver, Wash.

[73] Assignee: Hewlett-Packard Company, Palo Alto, Calif.

[21] Appl. No.: 08/960,587

[22] Filed: Oct. 29, 1997

[51] Int. Cl.[7] ..... B41J 2/165

[52] U.S. Cl. ..... 347/33

[58] Field of Search ..... 347/33, 22, 32

[56] References Cited

U.S. PATENT DOCUMENTS

| | | | |
|---|---|---|---|
| 5,467,114 | 11/1995 | Ebinuma et al. . | |
| 5,548,310 | 8/1996 | Binnert et al. | 347/33 |
| 5,563,637 | 10/1996 | Francis et al. | 347/32 |
| 5,602,573 | 2/1997 | Waschhauser et al. | 347/33 |
| 5,614,930 | 3/1997 | Osborne et al. | 347/33 |
| 5,786,830 | 7/1998 | Su et al. | 347/33 |
| 5,815,176 | 9/1998 | Rotering | 347/33 |
| 5,896,145 | 4/1999 | Osborne et al. | 347/33 |

FOREIGN PATENT DOCUMENTS

| | | | |
|---|---|---|---|
| 0465260A2 | 5/1990 | European Pat. Off. | B41J 2/165 |
| 30 42 998 A1 | 7/1982 | Germany | 347/33 |
| 404278358A | 10/1992 | Japan | 347/33 |

OTHER PUBLICATIONS

Patent Abstracts of Japan, Publication No. 02011332, published Jan. 16, 1990, Canon Inc.

Patent Abstracts of Japan, Publication No. 60031970, published Feb. 18, 1985, NEC Corp.

Patent Abstracts of Japan, Publication No. 62251145, published Oct. 31, 1987, Canon Inc.

*Primary Examiner*—N. Le
*Assistant Examiner*—Shih-Wen Hsieh
*Attorney, Agent, or Firm*—Flory L. Martin

[57] ABSTRACT

A hide-away wiper and wiper scraper system has a wiper that is extended to wipe ink residue from an inkjet printhead installed in an inkjet printing mechanism, and following wiping, ink residue is scraped from the wiper during retraction into a hide-away rest position inside the scraper mechanism. For cleaning several inkjet printheads, several such hide-away wipers may be provided in like number for cleaning the printheads. The hide-away nature of these wipers allows for independent movement of the wipers between their rest and wiping positions, which facilitates the uses of independent wiping routines tailored for the servicing needs of each printhead, or type of printhead. An inkjet printing mechanism having a hide-away wiping system, along with a method of cleaning one or more inkjet printheads, are also provided.

16 Claims, 6 Drawing Sheets

HIDE-AWAY WIPER CLEANER FOR INKJET PRINTHEADS

FIELD OF THE INVENTION

The present invention relates generally to inkjet printing mechanisms, and more particularly to a hide-away wiper and wiper scraper system, with the wiper being extended to wipe ink residue from an inkjet printhead installed in an inkjet printing mechanism, and following wiping, ink residue is scraped from the wiper during retraction into a hide-away rest position inside the scraper mechanism.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Since these permanent or semi-permanent printheads carry only a small ink supply, they may be physically more narrow than their predecessors, the replaceable cartridges. Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers.

There are a variety of advantages associated with these off-axis printing systems, but the permanent or semi-permanent nature of the printheads requires special considerations for servicing, particularly when wiping ink residue from the printheads, which must be done without any appreciable wear that could decrease printhead life. Indeed, keeping the nozzle face plate clean for cartridges using pigment-based inks has proven quite challenging. With the earlier dye-based inks, periodically wiping the printhead with an elastomeric wiper was sufficient. Any die-based ink residue on the wiper was removed by a small scraper regions along each side edge of the printhead, which was supplied as a replaceable cartridge so residue build-up over the lifetime of the printer was not an issue. However, with the advent of the pigment-based inks, a secondary operation of cleaning the wiper has become necessary to remove sticky pigment ink residue from the wiper. In the early printers using these pigment based inks, this secondary wiper cleaning operation was accomplished using a rigid plastic scrapper bar. Through relative motion of either the scrapper, the wiper blade, or both, the wiper was scrapped across the rigid scraper bar to remove ink from the surfaces of the wiper blade.

For instance, one earlier cam-operator wiper scraper system first used in the DeskJet® 850C and 855C models of inkjet printers, sold by the present assignee, the Hewlett-Packard Company of Palo Alto, Calif., required intricate ink wicking channels to draw the liquid portions of the ink away from the main scrapper surface and into an absorbent ink blotter member. Unfortunately, this cam-operated system required many complex parts, which increased the assembly costs as well as the part cost for manufacturing these printers. Another scraper system first sold by the Hewlett-Packard Company as the model 720CDeskJet® inkjet printer, moved the wipers translationally under a rigid plastic scraper bar. This translational scraping system, while being simpler to manufacture than the earlier cam-operated system, unfortunately required extra horizontal travel distance for the wipers to travel under the scraper bar. The travel distance also included an over-travel component beyond the scraper bar, known as a "wiper bend-over distance." This bend-over distance allowed the flexed wiper to return to an upright position following scraping of the first side of the wiper blade, and before reversing the direction of travel back under the bar to clean the other side of the blade. This extra travel distance then required a larger service station, which contributed to increasing the size of the printer's footprint.

Furthermore, in these earlier wiper scraper systems, the pigment-based ink residue often accumulated on the wiper surface in the form of a paste, which the earlier plastic scrapper was not totally effective in removing. Instead, when encountering this paste-like consistency of ink residue, the plastic scrapper tended to smear the ink on the surface of the wiper as the wiper blade flexed more, rather than removing the residue from the blade surface. Another drawback of the plastic scrapper is the tendency of the wiper blade when moving past the scrapper to flick ink off of the cleaning surface. This ink splatter or flicking action propelled the ink residue to other areas and components inside the printer service station, dirtying any surfaces where it landed. Finally, one of the major annoyances of the earlier wiper scrapers was the aggravating noise generated by the wiper scraping process.

Thus, a need exists for an inkjet printhead wiping system including a wiper cleaner capable that is quiet, avoids paste-like ink build-up on the wiper, minimizes dirty and noisy ink flicking from the blade, and minimizes the footprint size of the printing unit.

SUMMARY OF THE INVENTION

According to one aspect of the present invention, a wiping system is provided for cleaning an inkjet printhead in an inkjet printing mechanism as including a wiper having opposing first and second surfaces. The wiping system also has a moveable support that moves the wiper between a rest position and a wiping position at which the printhead moves across the wiper to deposit ink residue on at least one of the first and second surfaces of the wiper. The wiping system has a scraper mechanism with two opposing scraping edges that each engage one of the first and second surfaces of the wiper to scrape ink residue from these surfaces as the support moves the wiper from the wiping position to the rest position.

According to a further aspect of the present invention, an inkjet printing mechanism may be provided with a wiping system as described above.

According to yet another aspect of the present invention, a method is provided for cleaning an inkjet printhead in an inkjet printing mechanism, including the step of moving a wiper having opposing first and second surfaces toward the printhead and into a wiping position. In a wiping step, ink residue is wiped from the printhead with the wiper through relative motion of the wiper and the printhead to collect the ink residue on at least one of the first and second surfaces of the wiper. In a retracting step, the wiper is retracted from the wiping position to a rest position. During the retracting step, in a scraping step, the ink residue collected on the wiper is scraped from the wiper by pinching together the first and second surfaces of the wiper with a pair of scraper members.

An overall goal of the present invention is to provide an inkjet printing mechanism which prints sharp vivid images, particularly when using fast drying pigment-based or dye-based inks.

Another goal of the present invention is to provide a robust wiping system capable of reliably cleaning the nozzle face plate of an inkjet printhead with a clean wiper, without increasing the overall footprint of unit, to provide consumers with a quiet, compact and economical printing unit.

DETAILED DESCRIPTION OF A PREFERRED EMBODIMENT

Figure 1:
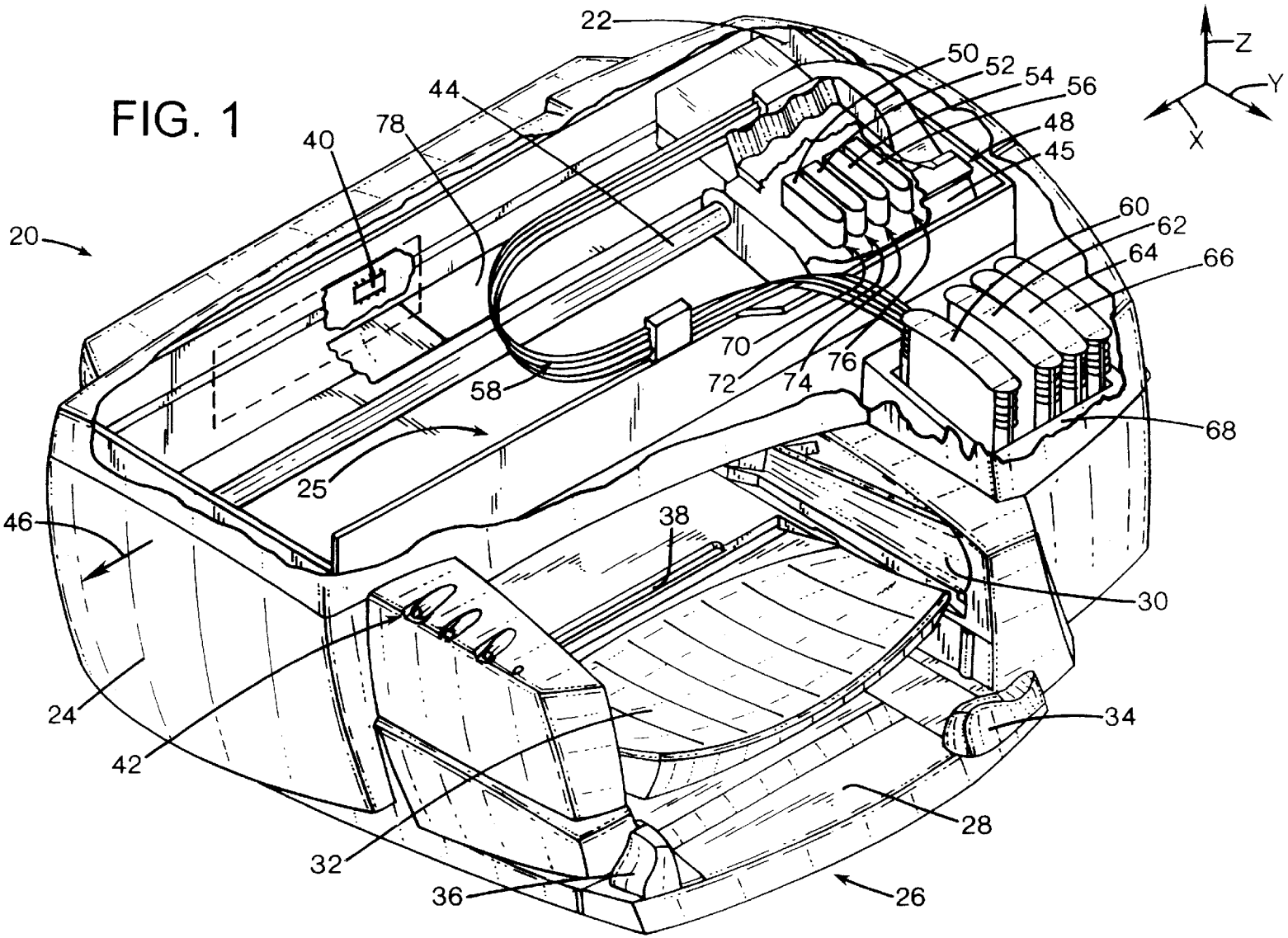
FIG. 1 is a perspective view of one form of an inkjet printing mechanism, here, an inkjet printer, including a printhead service station having one form of a hide-away wiper and wiper scraper system of the present invention for cleaning an inkjet printhead.

FIG. 1 illustrates an embodiment of an inkjet printing mechanism, here shown as an "off-axis" inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a printzone 25 by a media handling system 26. The print media may be any type of suitable sheet material, such as paper, card-stock, transparencies, photographic paper, fabric, mylar, and the like, but for convenience, the illustrated embodiment is described using paper as the print medium. The media handling system 26 has a feed tray 28 for storing sheets of paper before printing. A series of conventional paper drive rollers driven by a stepper motor and drive gear assembly (not shown), may be used to move the print media from the input supply tray 28, through the printzone 25, and after printing, onto a pair of extended output drying wing members 30, shown in a retracted or rest position in FIG. 1. The wings 30 momentarily hold a newly printed sheet above any previously printed sheets still drying in an output tray portion 32, then the wings 30 retract to the sides to drop the newly printed sheet into the output tray 32. The media handling system 26 may include a series of adjustment mechanisms for accommodating different sizes of print media, including letter, legal, A-4, envelopes, etc., such as a sliding length adjustment lever 34, a sliding width adjustment lever 36, and an envelope feed port 38.

The printer 20 also has a printer controller, illustrated schematically as a microprocessor 40, that receives instructions from a host device, typically a computer, such as a personal computer (not shown). The printer controller 40 may also operate in response to user inputs provided through a key pad 42 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 44 is supported by the chassis 22 to slideably support an off-axis inkjet pen carriage system 45 for travel back and forth across the printzone 25 along a scanning axis 46. The carriage 45 is also propelled along guide rod 44 into a servicing region, as indicated generally by arrow 48, located within the interior of the housing 24. A conventional carriage drive gear and DC (direct current) motor assembly may be coupled to drive an endless belt (not shown), which may be secured in a conventional manner to the carriage 45, with the DC motor operating in response to control signals received from the controller 40 to incrementally advance the carriage 45 along guide rod 44 in response to rotation of the DC motor. To provide carriage positional feedback information to printer controller 40, a conventional encoder strip may extend along the length of the printzone 25 and over the service station area 48, with a conventional optical encoder reader being mounted on the back surface of printhead carriage 45 to read positional information provided by the encoder strip. The manner of providing positional feedback information via an encoder strip reader may be accomplished in a variety of different ways known to those skilled in the art.

Figure 2:
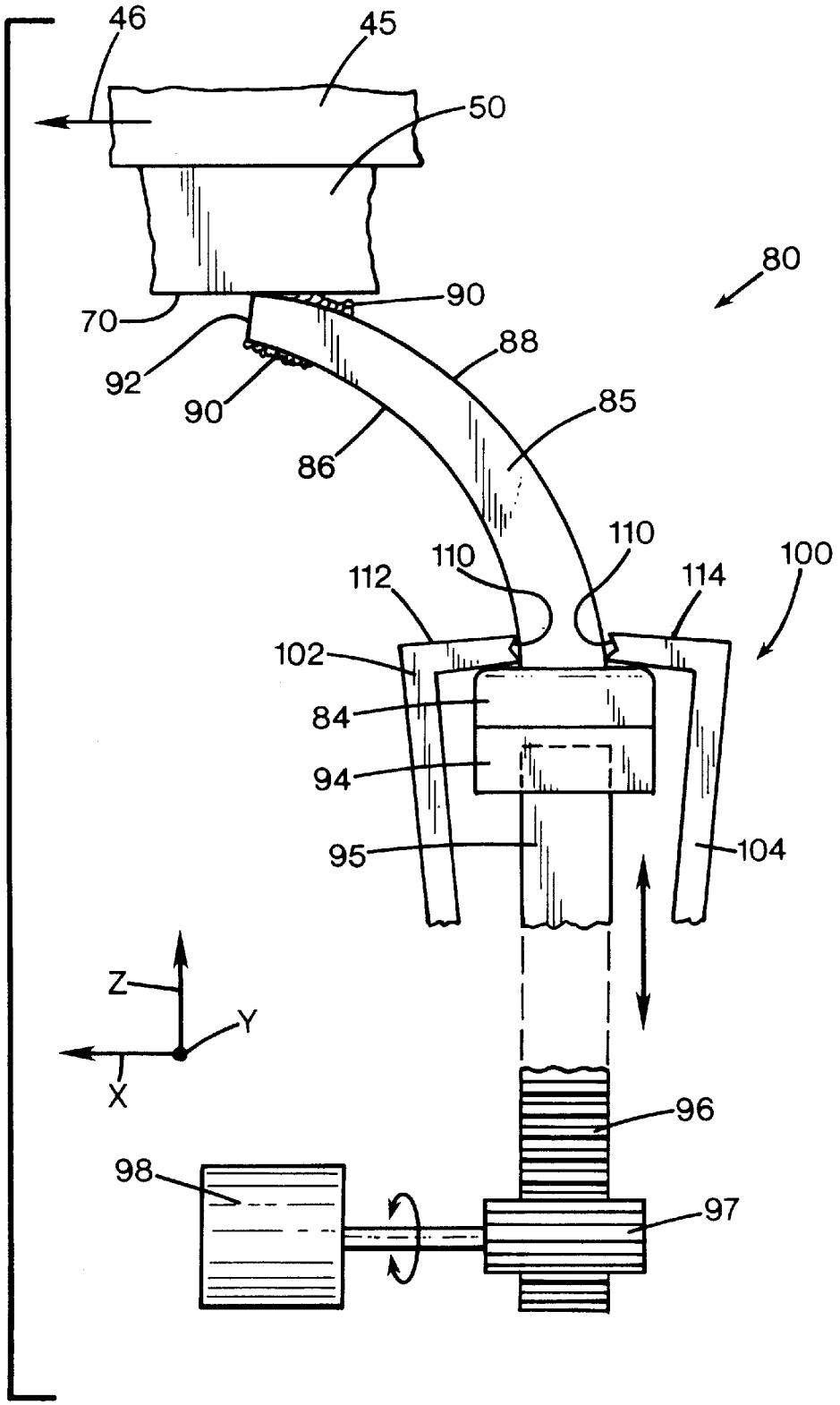
FIG. 2 is a partially schematic, side elevational view of the hide-away wiper system of FIG. 1, with a wiper blade shown extended in the operation of cleaning an inkjet printhead.

In the printzone 25, the media sheet 34 receives ink from an inkjet cartridge, such as a black ink cartridge 50 and three monochrome color ink cartridges 52, 54 and 56, shown schematically in FIG. 2. The cartridges 50–56 are also often called "pens" by those in the art. The black ink pen 50 is illustrated herein as containing a pigment-based ink. While the illustrated color pens 52–56 may contain pigment-based inks, for the purposes of illustration, color pens 52–56 are described as each containing a dye-based ink of the colors cyan, magenta and yellow, respectively. It is apparent that other types of inks may also be used in pens 50–56, such as paraffin-based inks, as well as hybrid or composite inks having both dye and pigment characteristics. It is apparent that inkjet printing mechanisms, of which printer 20 is only one example, may be equipped with other pen arrangements, such as a single pen, pens that dispense mutiple colors of ink, replaceable inkjet pens, or more than four pens.

The illustrated pens 50–56 each include small reservoirs for storing a supply of ink in what is known as an "off-axis" ink delivery system, which is in contrast to a replaceable cartridge system where each pen has a reservoir that carries the entire ink supply as the printhead reciprocates over the printzone 25 along the scan axis 46. Hence, the replaceable cartridge system may be considered as an "on-axis" system, whereas systems which store the main ink supply at a stationary location remote from the printzone scanning axis are called "off-axis" systems. In the illustrated off-axis printer 20, ink of each color for each printhead is delivered via a conduit or tubing system 58 from a group of main stationary reservoirs 60, 62, 64 and 66 to the on-board reservoirs of pens 50, 52, 54 and 56, respectively. The stationary or main reservoirs 60–66 are replaceable ink supplies stored in a receptacle 68 supported by the printer chassis 22. Each of pens 50, 52, 54 and 56 have printheads 70, 72, 74 and 76, respectively, which selectively eject ink to from an image on a sheet of media in the printzone 25. The concepts disclosed herein for cleaning the printheads 70–76 apply equally to the totally replaceable inkjet cartridges, as well as to the illustrated off-axis semi-permanent or permanent printheads, although the greatest benefits of the illustrated system may be realized in an off-axis system where extended printhead life is particularly desirable.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 46, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the printzone 25 under the nozzle. The printhead resistors are selectively energized in response to firing command control signals delivered by a multi-conductor strip 78 from the controller 40 to the printhead carriage 45.

FIGS. 2–5 illustrate one form of a hide-away wiper and wiper scraper system 80 constructed in accordance with the present invention, and mounted to the printer chassis 22, or alternatively to a portion of a service station frame 82 which is secured to chassis 22 within the servicing region 48. Extending from a base portion 84, is a wiper blade 85 of a resilient, non-abrasive, elastomeric material, such as nitrile rubber, and preferably an ethylene polypropylene diene monomer (EPDM), or other comparable materials known in the art. The durometer of the wiper blade 85 may range from 35–90 on the Shore A scale, and more preferably is selected from the range of 50–70 on the Shore A scale. The wiper blade 85 has an inboard wiping surface 86, and an opposing outboard wiping surface 88, each of which are shown coated with an ink residue 90 in FIGS. 2–4. It is apparent to those skilled in the art that an exaggerated amount of ink residue 90 is shown as being deposited on the wiper blade 85 in FIGS. 2–5 for the purposes of illustration only, and the normal amount of residue accumulated on the blade 85 during a wiping sequence is typically far less.

In the fragmented view of FIG. 2, a portion of the printhead carriage 45 is shown moving one of the pens, here the black pen 50, to the left along the scanning axis 46, toward the printzone 25 for printing. Prior to the step of FIG. 2, where ink residue 90 is shown being accumulated along the outboard blade surface 88, the carriage 45 moved the pen 50, along with the other pens 52–56, in the opposite direction, that is to the right in FIG. 2, where ink residue 90 was scraped off of the printhead 70 and accumulated on the inboard blade surface 86.

The illustrated wiper blade 85 has a distal end wiping tip 92, which is illustrated as being rectangular in shape, although in other embodiments the wiping tip 92 may be specially contoured to enhance the wiping capabilities of blade 85. While a single wiper blade 85 is illustrated to describe the concepts of the present invention, it is apparent that the printer 20 may be equipped with similar wiper blades to clean the color printheads 72–76. Alternatively, since the black pigment based ink of pen 50 has proven particularly difficult to wipe and maintain, wipers used to clean the color printheads 72–76 may take on a more conventional nature, omitting a scraper system if it proves unnecessary to adequately wipe the color printheads.

To remove the ink residue 90 accumulated on the wiping surfaces 86, 88 of blade 85, the wiper base 84 is mounted on a moveable support platform 94. The platform 94 is attached to an actuator mechanism, such as actuator arm 95 for movement toward and away from the printhead 70, here, shown as vertical movement in the Z-axis direction. A variety of different mechanisms may be used to move the actuator arm 95 toward and away from the printhead 70. In the illustrated embodiment, a rack and pinion gear mechanism is used, including a rack 96 driven by a pinion gear 97, which is coupled to an output shaft of a drive motor 98. It is apparent that other mechanisms may be used to move the actuator arm 95 toward and away from the printhead 70, such as solenoids (FIGS. 6 and 7), pistons, and levers, cams or gears, some of which may even be actuated through movement of the printhead carriage 45.

Figure 3:
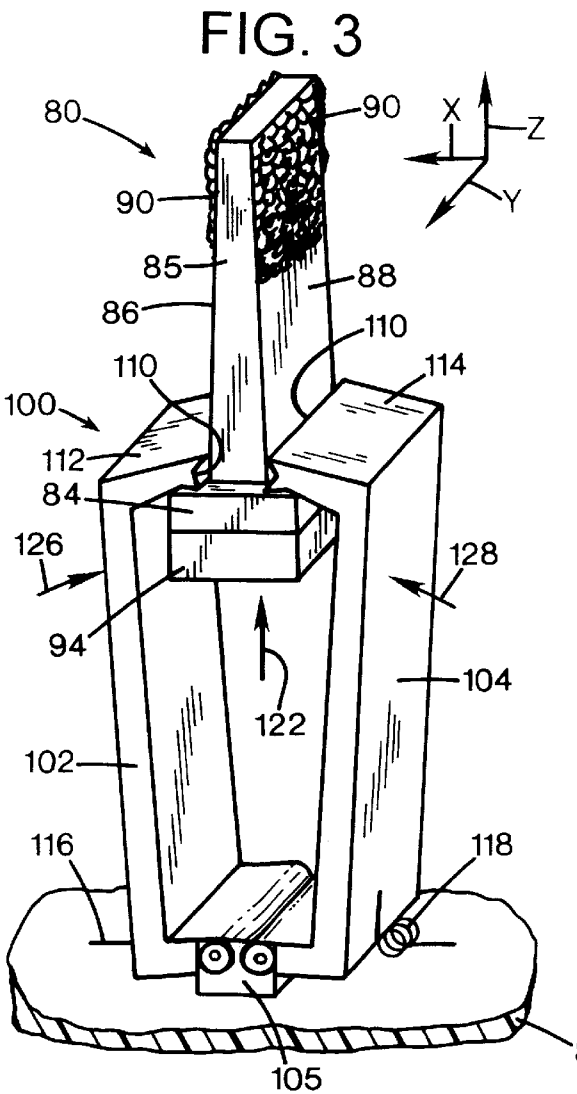
FIG. 3 is an enlarged perspective view of the hide-away wiper system, following the wiping operation of FIG. 2.
Figure 4:
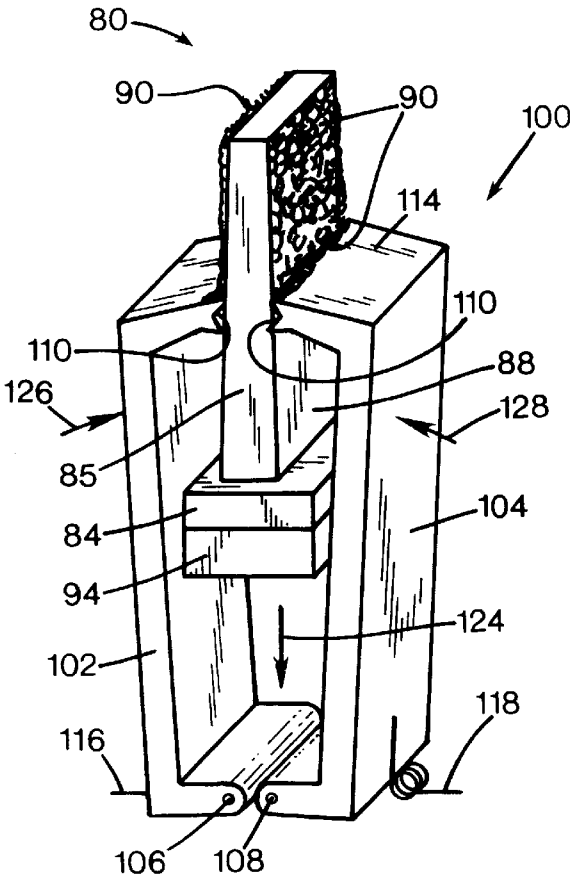
FIG. 4 is an enlarged perspective view of the hide-away wiper system, shown being retracted in the operation of scraping ink residue from the wiper blade.
Figure 5:
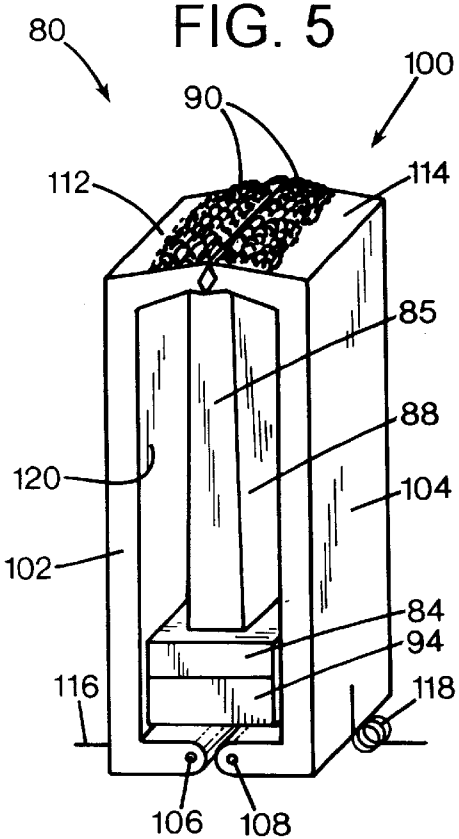
FIG. 5 is an enlarged perspective view of the hide-away wiper system, with a wiper blade shown in a retracted rest position following the scraping operation of FIG. 4.

The hide-away wiper system 80 includes a wiper scraper system 100, here shown as two clam shell scraper members or arms 102 and 104, which are pivotally attached to a pair of support members 105 extending upwardly from the service station frame 82, such as at hinge points 106, 108, as shown in FIG. 3. To the extent practicable, the term "wipe" is used herein to designate cleaning of the printheads, and the term "scrape" is used to describe cleaning of the wiper following a printhead cleaning sequence. Each of the scraper arms 102 and 104 terminates in a distal scraper edge 110. Each arm 102, 104 has a shoulder portion, such as shoulders 112 and 114, respectively, adjacent to the scraper edges 110. Each scraper arm 102, 104 is biased in a direction toward the wiper blade 85, to squeeze the blade between the scraping edges 110, with this biasing action being provided by spring members 116 and 118 as shown in FIGS. 3–5. Rather than the coiled springs 116, 118, a variety of different mechanisms may be used to bias the scraper arms 102, 104 toward each other, such as leaf springs or torsional springs mounted at hinges 106, 108. The scraper arms 102, 104 form a shroud, with the interior region of the shroud, between the arms defining a wiper storage chamber 120, into which the wiper blade 85 is retracted for storage in a rest position as shown in FIG. 5. While the illustrated embodiment shows the scraper edges 110 touching the side surfaces 86, 88 during the wiping step of FIG. 2, it may be preferable to fashion the base 84 to move the scraper arms 102, 104 out of contact with blade 85 during the wiping stroke to assure there is no interference of the scraper arms 102, 104 with the flexure of blade 85 during wiping.

In operation, the actuator arm 95 moves the wiper blade 85 toward the printhead 70 into a wiping position as illustrated schematically by arrow 122 in FIG. 3. As shown for printhead 70 in FIG. 2, wiping is then accomplished by reciprocating the printhead back and forth, in one or more wiping strokes, over the wiper blade 85 to remove ink residue 90 from the orifice plate of printhead 70. During wiping, this residue 90 is collected along the inboard and outboard surfaces 86 and 88 of the wiper blade 85, as shown in FIGS. 2 and 3. To remove this ink residue 90 from the wiper blade 85, and to move the blade out of the wiping position, the actuator arm 95 is lowered, for instance, by operation of the motor 98 in cooperation with the rack and pinion gears 96, 97, to retract the wiper blade into the storage chamber 120, as illustrated schematically by arrow 124 in FIG. 4.

During this retraction step, the biasing force provided by the springs 116, 118 pushes the scraper edges 110 of arms 102, 104 into contact with the respective side surfaces 86, 88 of blade 85, as indicated by the curved arrows 126, 128 in FIGS. 3 and 4. Preferably, the scraping edge 110 of arms 102, 104 is contoured, such as with a recess, and preferably with a V-shaped trough extending along the length of each edge 110. The upper edge of this V-shaped trough configuration advantageously provides a first scraping edge for removing the majority of the residue 90 from the blade 85, while the lower edge of the trough forming a second scraping edge for performing a final cleaning operation to remove any residue film which may still be clinging to the wiping surfaces 86, 88. In the past as discussed in the Background section above, when the wipers passed under the earlier scraper bars, these blades could over-flex, allowing the scraper bar to ride over the residue accumulation on the blade, rather than scraping it off. This problem is avoided with the pinching action provided by scraper arms 102, 104 which prevents the wiper blade 85 from flexing away from either of the scraper edges 110. Thus the hide-away wiper scraper system 80 advantageously avoids a build-up of smeary ink residue on the wiper blade 85, even when wiping the pigment-based black ink of pen 50.

The scraping action provided by the edges 110 then accumulates the ink residue along the shoulder portions 112, 114 of arms 102, 104 as the blade 85 is retracted into a rest position as shown in FIG. 5. In this the rest position, the wiper blade 85 is housed within the storage chamber 120 in a clean condition, and out of the path of printhead travel. Upon exiting the storage chamber 120, the actuator arm 95 moves the wiper blade 85 toward the printhead and only the clean lower edge of the V-shaped trough of the wiping edge 110 contacts side surfaces 86, 88 of the wiper blade.

Figure 7:
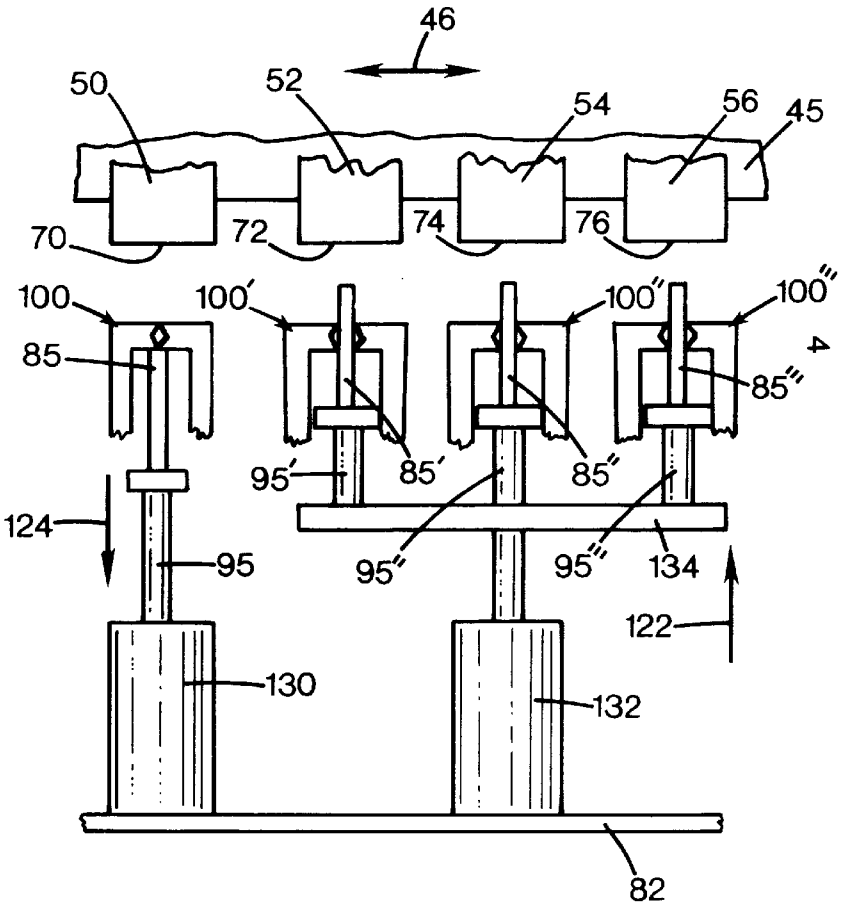
FIGS. 6 and 7 are partially schematic, front elevational views of the hide-away wiper and wiper scraper system of FIG. 1, with FIG. 6 showing a step of independent wiping of a black printhead, and FIG. 7 showing a step of independent wiping of several color printheads.
Figure 6:
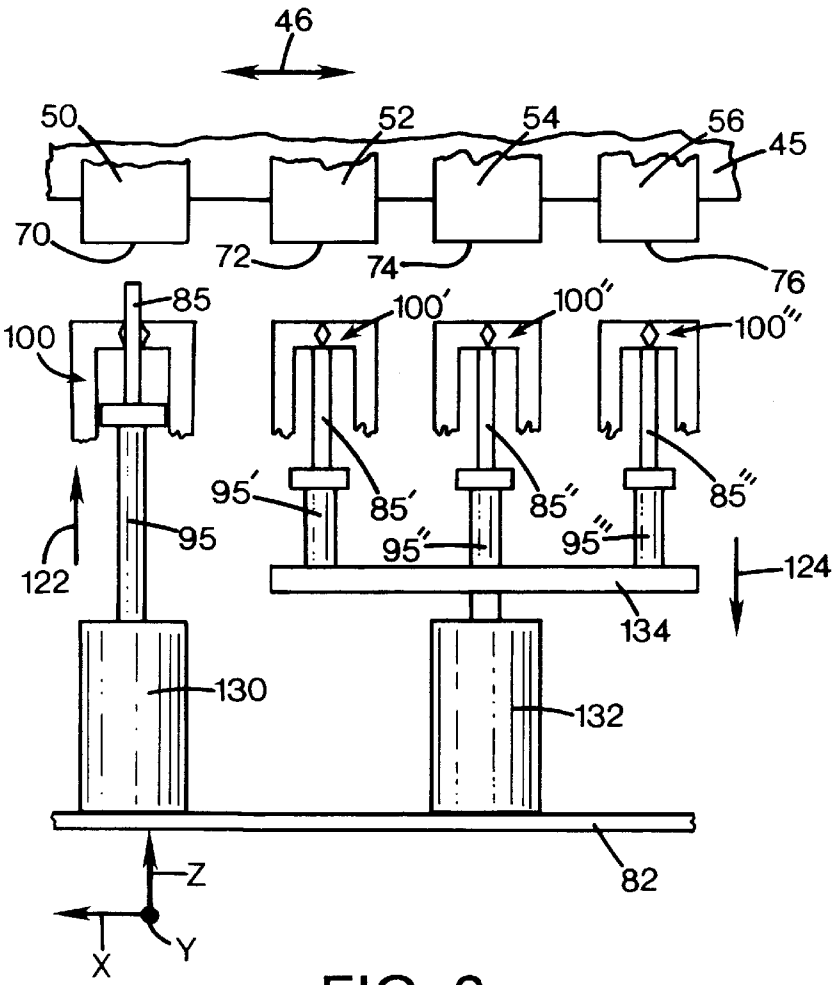

As shown in FIGS. 6 and 7, the hide-away wiper system 80 facilitates separate, individual wiping of the black printhead 70 (FIG. 6), independent from wiping of the color printheads 72–76 (FIG. 7). Here, the system 80 is shown as including three additional hide-away wiper blades 85', 85" and 85"' for wiping the respective color printheads 72, 74 and 76. The system 80 also has three additional scraper mechanisms 100', 100" and 100"' for cleaning residue from the wiper blades 85', 85" and 85"', respectively. In the embodiment of FIGS. 6 and 7, the motor driven rack and pinion gears 96, 97 of FIG. 2 have been replaced with a solenoid 130 driving the black wiper support arm 95 between wiping and rest positions. In the illustrated embodiment, rather than individually wiping each color printheads 72–76, it is preferable to simultaneously wipe the color printheads. Thus, a single color solenoid 132 is used to drive a support member 134 to which color wiper actuator arms 95', 95" and 95" are coupled to move the blades 85', 85" and 85"' between rest and wiping positions. In FIG. 6, the black wiper 85 is shown being elevated by solenoid 130 to the wiping position, as indicated by arrow 122, whereas the color wipers 85', 85" and 85"' have been retracted by solenoid 132 to the rest positions, as indicated by arrow 124. In FIG. 7, the color wipers 85', 85" and 85"' are shown being elevated to the wiping position, as indicated by arrow 122, whereas the black wiper 85 has been retracted to the rest position, as indicated by arrow 124.

The wiping system 80 allows selective wiping of the printheads, including customized wiping speeds and sequences to be employed for cleaning the black printhead 70 and for cleaning the color printheads 72–76. For instance, the color pens 52–56 carrying dye-based inks may be wiped with blades 85', 85" and 85"' using a faster wiping speed than required for wiping the black pen 50, which dispenses a black pigment-based ink. In the past, many service stations used wipers that required both the black and color printheads to be wiped simultaneously, so compromises had to be made between the optimum wiping speeds for the black pigment-based ink and the color dye-based inks. Problems were encountered in the past because the slower wiping strokes required to clean the black printheads extracted excess ink from the color printheads. When using a faster wiping stroke for the color pens, so there was no time for the color ink to seep out between the orifice plates and the color wipers, the black wiper would then skip over black ink residue on the black printhead. These problems are avoided by the hide-away wiper system 80, which can selectively elevate and retract the wiper blades into and out of the servicing position as shown in FIGS. 6 and 7, thus allowing wiping to be optimized for both the black printhead 70 and for the color printheads 72–76.

Figure 8:
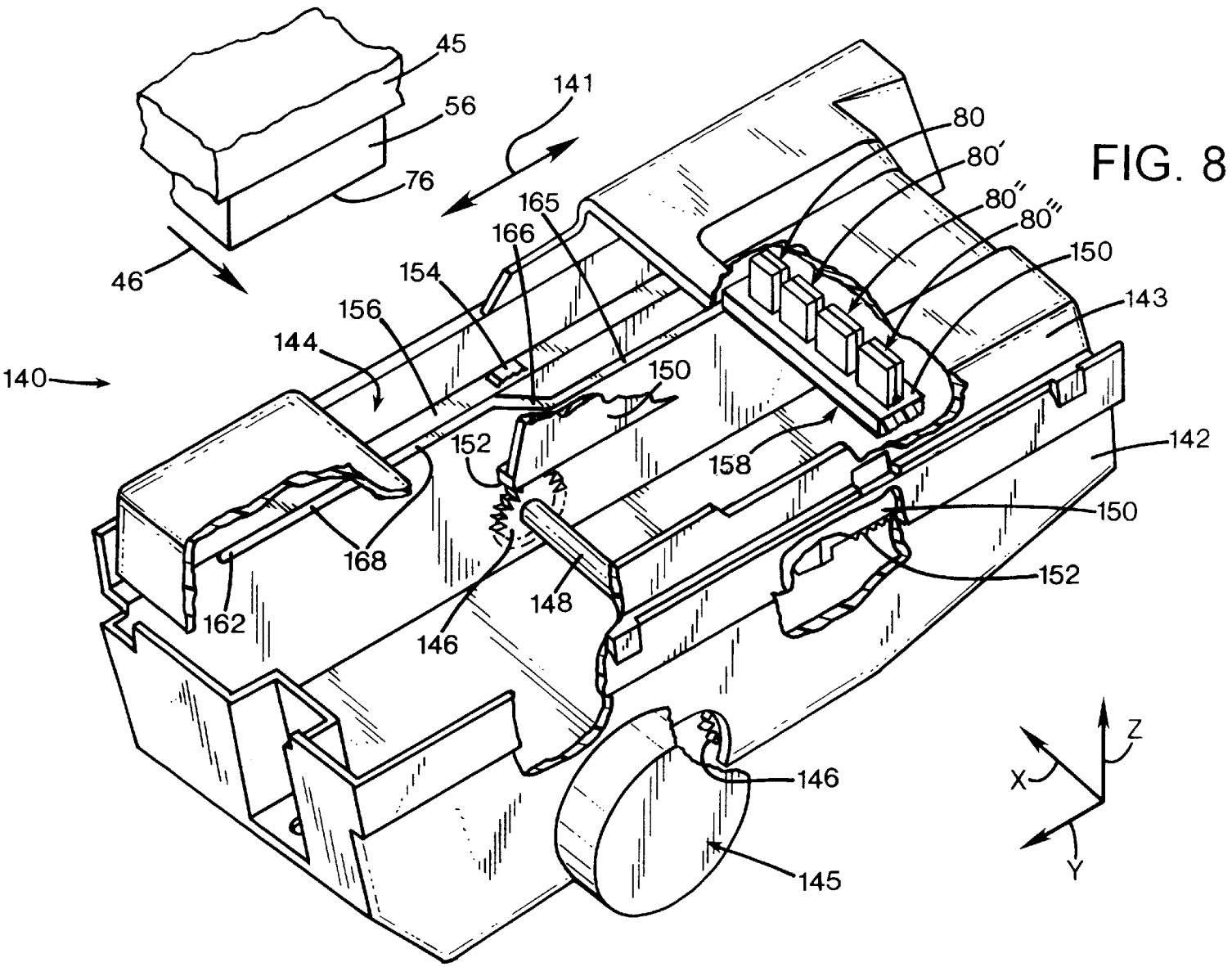
FIG. 8 is an enlarged perspective view of an alternate embodiment of a hide-away wiper system of the present invention, shown in a rest position.
Figure 9:
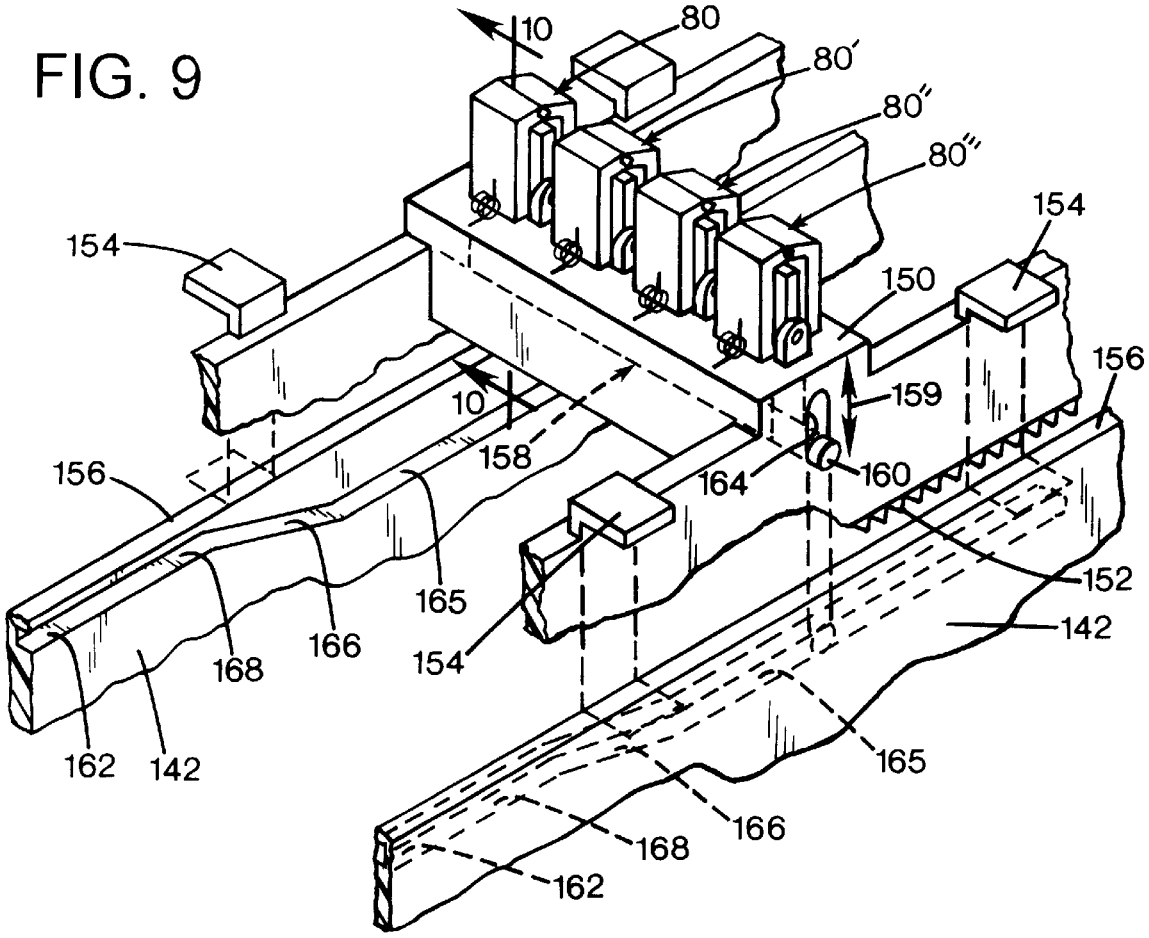
FIG. 9 is a fragmented perspective view of the hide-away wiper system of FIG. 8.
Figure 10:
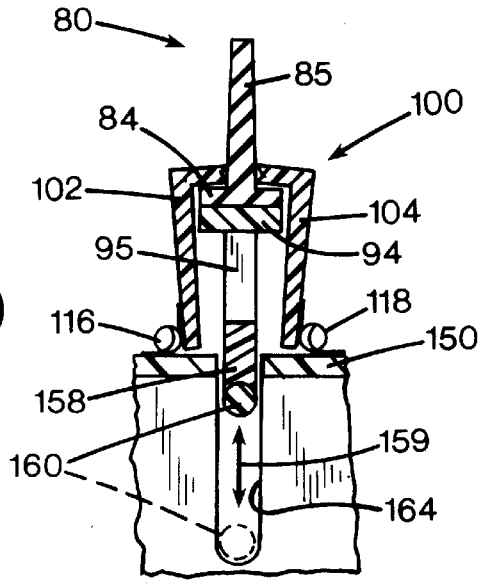
FIG. 10 is a side elevational view taken along lines 10—10 of FIG. 8.

FIGS. 8–10 show the hide-away wiper system 80 installed in a translational service station 140 which facilitates orthogonal wiping, that is, wiping along the length of the linear nozzle arrays of printheads 70–76, as indicated by arrow 141, which is perpendicular to the scan axis 46. The service station 140 includes a frame base member 142 supported by the printer chassis 22, and an upper frame portion or bonnet 143. The frame base 142 may also serve as a spittoon 144 for receiving ink spit from printheads 70–76. The exterior of the base 142 supports a conventional service station drive motor and gear assembly 145, which may include a stepper motor, that is coupled to drive one of a pair of drive gears 146 of a spindle pinion drive gear assembly 148. The spindle gear 148 drives a translationally movable wiper support platform or pallet 150 in the directions indicated by arrow 141 for printhead servicing. The pair of spindle gears 146 each engage respective gears of a pair of rack gears 152 formed along a lower surface of pallet 150. The pallet 150 has sliding supports 154 that ride in tracks 156 defined along the interior surfaces of the frame base and/or bonnet 142, 143 for translational movement.

The service station 140 has four hide-away wiper scraper systems 80, 80', 80" and 80'" for wiping the respective color printheads 72, 74 and 76. Each of the four hide-away wiper scraper systems 80, 80', 80" and 80'" is understood to include a scraper mechanism, such as mechanism 100, although not separately numbered in FIGS. 8–10, for cleaning residue from the wipers in the same manner as described above with respect to FIGS. 4–6.

Here, the actuators 95 of each system 80–80'" is mounted on a vertically moveable support member 158, coupled to the pallet 150 for motion toward and away from the printheads, as indicated by arrow 159. The wiper support 158 includes a pair of cam follower pins, such as pin 160, that ride in a pair of wiper acuating cam tracks 162 defined along the interior surfaces of the frame base and/or bonnet 142, 143. The pins 160 extend through a slot 164 defined by a portion of the pallet 150, as shown in FIGS. 9 and 10. Each track 162 includes a rest zone 165 where the wiper blades 85 are retracted into their respective shrouds, a transition zone 166 where the wipers are raised and lowered, and a wiping zone where the blades 85 are elevated to their servicing positions.

In operation, the illustrated embodiment, as the service station drive motor and gear assembly 145 moves the pallet 150 from the rest position of FIG. 8 toward the front of the printer, to the left in the views of FIGS. 8 and 9, the cam follower pins 160 ride through the transition zone 166. In the transition zone 166, the blades 85 are elevated to their wiping positions, preferably after the carriage 45 has moved all of the printheads 70–76 into their respective servicing positions over the service station 140. The forward motion continues as the pins 166 traverse the wiping zone 168 of track 162 through a wiping stroke. The wiping may be bi-directional by moving the pallet 150 back and forth while pins 160 are in the wiping zone 168. Following wiping, the pallet 150 then moves toward the rear of the service station 140, to the right in FIGS. 8 and 9, drawing the pins 160 through the transition zone 166. During this retreat through the transition zone 166, the wiper blades 85 are retracted through the scraper edges 110 for the wiper scraping step, as described with respect to FIG. 4 above. The pallet 150 continues to move rewardly until coming to a rest position where the pins 160 are in the rest zone 165 of track 162, leaving the wiper blades 85 clean and stored inside the shrouding arms 102 and 104.

CONCLUSION

Thus, a variety of advantages are realized using the hide-away wiper and scraper system 80. For example, wiper cleaning is accomplished without requiring extra horizontal travel of the wiper, so the overall footprint of the printer unit 20 is not unduly increased by the use of the hide-away wiper system 80. Additionally, the ability to elevate the wiper blades 85 independently into and out of wiping positions, allows for independent wiping routines of pens having different service requirements, such as the black pen 50 and the color pens 52–56. Moreover, use of the pinching nature of the scraper arms 102, 104 advantageously removes smeary ink film residue from the wiper blade 85, in a fashion superior to that possible using a single scraper bar in the earlier inkjet printing mechanisms.

The hide-away wiper system 80 also facilitates the construction of a more compact service station by allowing the spittoon or spit zone to be located adjacent to the wipers. The shroud provided by arms 102, 104 advantageously shields the wiper 85 from being coated with the ink spit residue and keeps the wiper 85 clean when at rest. For instance, in service station 140 of FIGS. 8–10 may have the rest zone 165 of the cam track 162 located adjacent the spittoon portion 144.

Additionally, the hide-away wiper system 80 cleans the wiper blade 85 without flicking ink into undesirable locations within the service station, and without generating the undesirable noise from this wiper flicking operation of scraper bars in the earlier inkjet printers. Without the ink being flicked into undesirable locations, the various printhead servicing components may be more compactly arranged within the servicing region 48 of printer 20. Thus, use of the hide-away wiping system 80 advantageously provides an inkjet printer with a smaller footprint, which is quieter, and which consistently presents clean wiping surfaces to clean the inkjet printheads 70–76, to maintain high print quality in an economical printing unit for consumers.

I claim:

1. A wiping system for cleaning an inkjet printhead which has accumulated ink residue thereon while in an inkjet printing mechanism, comprising:

a wiper having two opposing surfaces;

a moveable support that moves the wiper between a rest position and a wiping position whereat the wiper accumulates ink residue from the printhead, leaving the residue clinging on at least one of the wiper surfaces;

a scraper mechanism comprising a pair of arms terminating in opposing scraping edges each engaging one of the wiper surfaces to scrape the clinging ink residue therefrom as the support moves the wiper from the wiping position to the rest position; and a pair of spring members each urging said arms into mutual engagement at the scraping edges.

2. A wiping system according to claim 1 wherein the scraper mechanism arms each have a proximate end opposite from said scraping edge, with each arm being pivotally attached at the proximate end to a frame portion of the printing mechanism.

3. A wiping system according to claim 1 wherein the scraper mechanism arms define therebetween a storage chamber into which the wiper is moved to the rest position.

4. A wiping system according to claim 1 further including a motor driven gear assembly coupled to the moveable support to move the wiper between the rest position and the wiping position.

5. A wiping system according to claim 1 further including a solenoid coupled to the moveable support to move the wiper between the rest position and the wiping position.

6. A wiping system for cleaning an inkjet printhead which has accumulated ink residue thereon while printing in an inkjet printing mechanism, comprising:

a wiper having two opposing surfaces;

a moveable support that moves the wiper between a rest position and a wiping position whereat the wiper accumulates ink residue from the printhead, leaving the residue clinging on at least one of the wiper surfaces; and a scraper mechanism comprising a pair of arms each terminating in a scraper edge having first and second scraping portions separated by a recess therebetween, with each scraper edge engaging one of the wiper surfaces to scrape the clinging ink residue thereon as the support moves the wiper from the wiping position to the rest position.

7. A wiping system for cleaning an inkjet printhead which has accumulated ink residue thereon while in an inkjet printing mechanism, comprising:

a wiper having two opposing surfaces;

a moveable support that moves the wiper between a rest position and a wiping position whereat the wiper accumulates ink residue from the printhead, leaving the residue clinging on at least one of the wiper surfaces; and a scraper mechanism comprising a pair of arms each terminating in opposing proximate and distal ends, with the distal end of each arm having a scraping edge each engages one of the wiper surfaces to scrape the clinging ink residue therefrom as the support moves the wiper from the wiping position to the rest position, and with each arm being pivotally attached at the proximate end to a frame portion of the printing mechanism to define therebetween a storage chamber into which the wiper is moved to the rest position, and with the scraper mechanism further including a pair of spring members each urging said arms into mutual engagement at the scraping edges.

8. An inkjet printing mechanism, comprising:

an inkjet printhead;

a carriage that reciprocates the printhead through a printzone for printing and to a servicing region for printhead servicing;

a wiper having opposing first and second surfaces;

a moveable support that moves the wiper between a rest position and a wiping position in the servicing region so when in the wiping position the carriage moves the printhead across the wiper to leave ink residue clinging on at least one of the first and second surfaces of the wiper; and a scraper mechanism having two opposing scraping edges each engaging one of the first and second surfaces of the wiper to scrape clinging ink residue therefrom as the support moves the wiper from the wiping position to the rest position, wherein the scraper mechanism further includes a pair of arms each having a distal end terminating in one of said scraping edges, with each of the arms having a proximate end opposite from said distal end, and with each arm being pivotally attached at the proximate end to a frame portion of the printing mechanism to define therebetween a storage chamber into which the wiper is moved to the rest position, and with the scraper mechanism further including a pair of spring members each urging said arms into mutual engagement at the scraping edges.

9. An inkjet printing mechanism according to claim 8 further including an actuator member coupled to the moveable support to move the wiper between the rest position and the wiping position.

10. An inkjet printing mechanism according to claim 8 further including:

a second inkjet printhead also reciprocated by the carriage through the printzone and servicing region;

a second wiper having opposing first and second surfaces;

a second moveable support that moves the second wiper between a rest position and a wiping position in the servicing region so when in the wiping position the carriage moves the second printhead across the second wiper to deposit ink residue on at least one of the first and second surfaces of the second wiper;

a second scraper mechanism having two opposing scraping edges each engaging one of the first and second surfaces of the second wiper to scrape ink residue therefrom as the second support moves the second wiper from the wiping position to the rest position;

a first actuator member coupled to said moveable support to move said wiper between the rest position and the wiping position; and a second actuator member coupled to the second moveable support to move the second wiper between the rest position and the wiping position, independent of movement of said wiper by said first actuator member.

11. An inkjet printing mechanism according to claim 10 further including:

a third inkjet printhead also reciprocated by the carriage through the printzone and servicing region;

a third wiper having opposing first and second surfaces;

a third moveable support that moves the third wiper between a rest position and a wiping position in the servicing region so when in the wiping position the carriage moves the third printhead across the third wiper to deposit ink residue on at least one of the first and second surfaces of the third wiper;

a third scraper mechanism having two opposing scraping edges each engaging one of the first and second surfaces of the third wiper to scrape ink residue therefrom as the third support moves the third wiper from the wiping position to the rest position; and wherein the second actuator member coupled to the third moveable support to move the third wiper between the rest position and the wiping position to simultaneously wipe both the second and third inkjet printheads.

12. A method of cleaning a first inkjet printhead and a second inkjet printhead in an inkjet printing mechanism, comprising the steps of:

moving a first wiper having opposing first and second surfaces toward the first printhead and into a wiping position;

wiping ink residue from the first printhead with the first wiper through relative motion of the first wiper and the first printhead, leaving ink residue clinging on at least one of the first and second surfaces of the first wiper;

retracting the first wiper from the wiping position to a rest position;

during the retracting step, scraping the clinging ink residue from the first wiper by pinching together the first and second surfaces of the first wiper with a first pair of scraper members;

moving a second wiper having opposing first and second surfaces toward the second printhead and into a wiping position;

wiping ink residue from the second printhead with the second wiper through relative motion of the second wiper and the second printhead to collect said ink residue on at least one of the first and second surfaces of the second wiper;

retracting the second wiper from the wiping position to a rest position; and during the step of retracting the second wiper, scraping ink residue collected on the second wiper by pinching together the first and second surfaces of the second wiper with a second pair of scraper members.

13. A method according to claim 12 further including the steps of:

storing the first wiper in the rest position in a first storage chamber defined by the first pair of scraper members; and storing the second wiper in the rest position in a second storage chamber defined by the second pair of scraper members.

14. A method according to claim 12 wherein:

the step of moving said wiper is conducted independently of the step of moving said second wiper; and the step of retracting said wiper is conducted independently of the step of retracting said second wiper.

15. A method according to claim 12 for cleaning a third printhead of the inkjet printing mechanism, further including the steps of:

moving a third wiper having opposing first and second surfaces toward the third printhead and into a wiping position;

wiping ink residue from the third printhead with the third wiper through relative motion of the third wiper and the third printhead to collect said ink residue on at least one of the first and second surfaces of the third wiper;

retracting the third wiper from the wiping position to a rest position; and during the step of retracting the third wiper, scraping ink residue collected on the third wiper by pinching together the first and second surfaces of the third wiper with a third pair of scraper members.

16. A method according to claim 15 wherein:

the step of moving the third wiper is conducted simultaneously with the step of moving said second wiper; and the step of retracting the third wiper is conducted simultaneously with the step of retracting said second wiper.

* * * * *